United States Patent [19]

Sandell

[11] 4,092,737

[45] May 30, 1978

[54] METHOD FOR PREPARING FIBERS FOR MIXING INTO A SPRAYED CONCRETE MASS AND A DEVICE FOR PERFORMING THE METHOD

[76] Inventor: Bertil Sandell, Hovås, Sweden 43080

[21] Appl. No.: 710,702

[22] Filed: Aug. 2, 1976

[30] Foreign Application Priority Data

Aug. 11, 1975 Sweden ..... 7508720

[51] Int. Cl.[2] ..... B28C 5/20; B28C 5/40; B28C 5/46

[52] U.S. Cl. ..... 366/3; 366/8; 366/10; 366/19; 366/31

[58] Field of Search ..... 19/.46, .48, .51, .56, 19/.58, .6, 155, 156, 156.3, 156.4, 65 R, 150; 259/147, 148, 149, 151, 154, 164, 175, 176, 177 R, 3, 14

[56] References Cited

U.S. PATENT DOCUMENTS

| | | | |
|---|---|---|---|
| 2,014,947 | 9/1935 | McCulloch et al. | 19/.46 X |
| 2,577,784 | 12/1951 | Lynam | 19/156 X |
| 2,719,336 | 10/1955 | Stotler | 19/.51 |
| 3,093,364 | 6/1963 | Schoonover | 259/146 |
| 3,452,400 | 7/1969 | Kane et al. | 19/65 R |
| 3,547,412 | 12/1970 | Klages | 259/148 |
| 3,643,416 | 2/1972 | Andrews et al. | 19/.56 X |
| 3,675,409 | 7/1972 | Rosenstein | 19/.46 X |
| 3,751,011 | 8/1973 | Milik | 259/146 |
| 3,812,553 | 5/1974 | Marshall et al. | 19/156.3 |
| 3,894,315 | 7/1975 | Fukuta et al. | 19/156 X |
| 3,995,867 | 12/1976 | Katzenberger | 259/148 |

FOREIGN PATENT DOCUMENTS

| | | | |
|---|---|---|---|
| 648,410 | 9/1962 | Canada | 19/155 |
| 934,194 | 8/1963 | United Kingdom | 19/150 |
| 1,142,039 | 2/1969 | United Kingdom | 19/155 |

*Primary Examiner*—Robert W. Jenkins
*Attorney, Agent, or Firm*—Holman & Stern

[57] ABSTRACT

The invention provides a method and apparatus for preparing precut steel fibers initially packed in bundles or occurring as closely packed lumps for mixing with concrete as a sprayed mass, the method comprising the steps of tumbling the bundles or lumps of fibers, dropping quantities of the fibers onto an inclined plane, subjecting the fibers to an air stream to cause said fibers to become parallel to each other, and mixing the fibers with a mass of concrete in the air stream.

18 Claims, 6 Drawing Figures

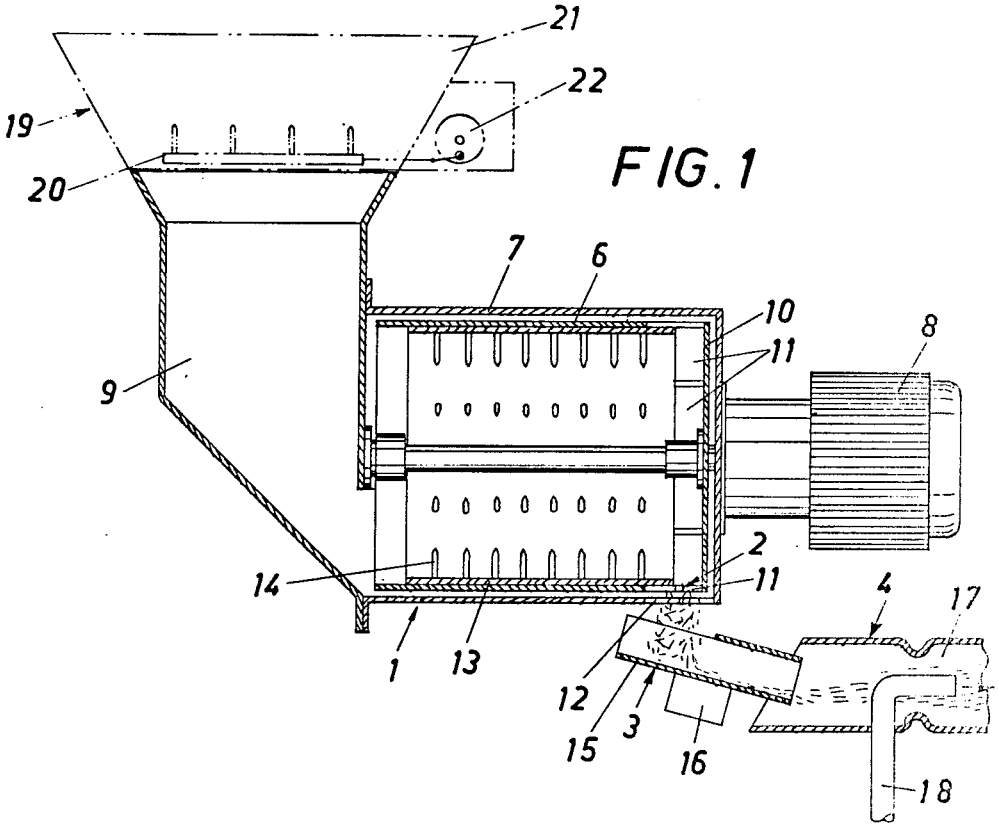
FIG. 1
FIG. 2
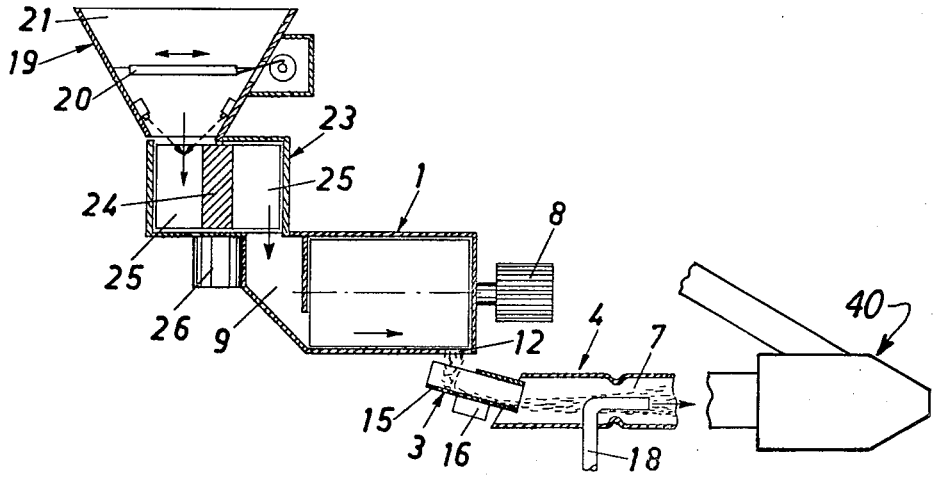

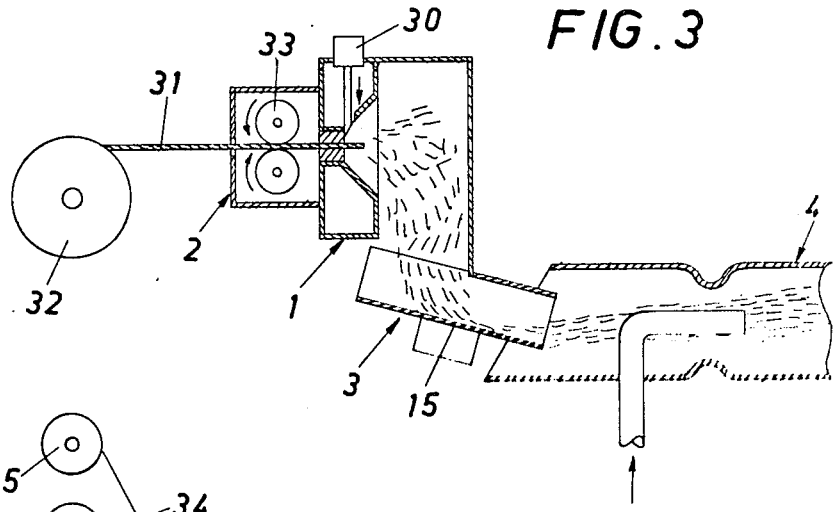
FIG. 3
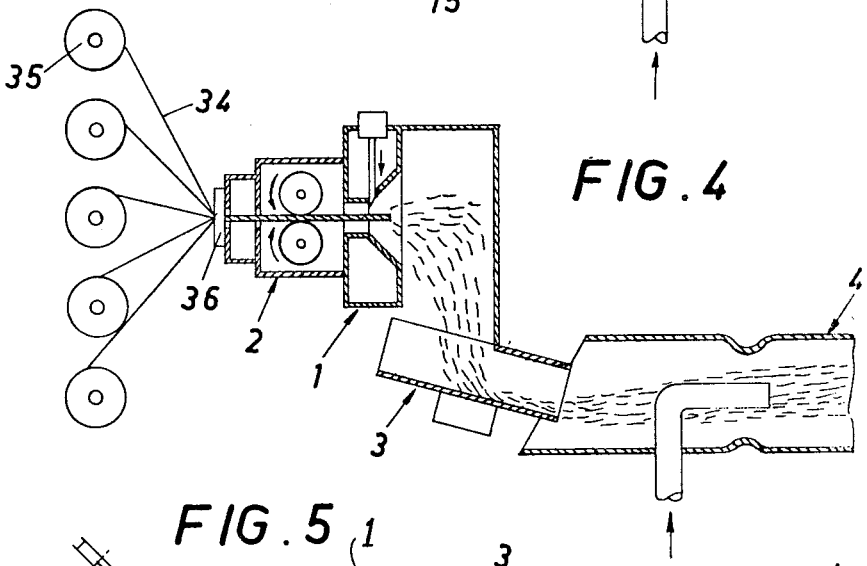
FIG. 4
FIG. 5
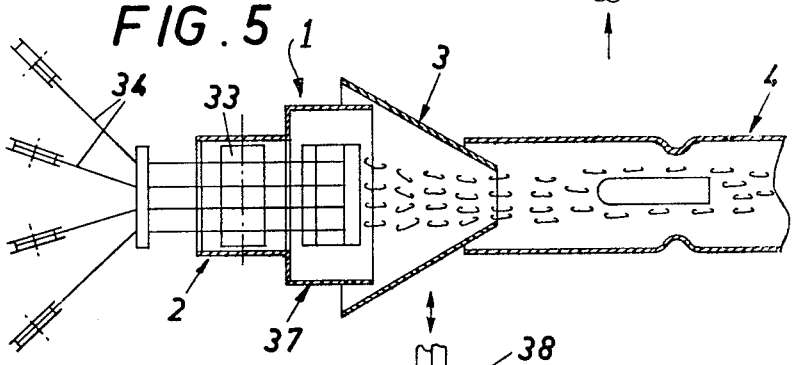
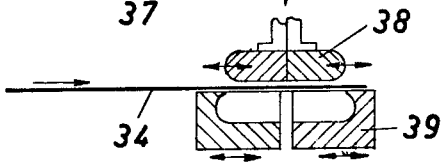
FIG. 6

METHOD FOR PREPARING FIBERS FOR MIXING INTO A SPRAYED CONCRETE MASS AND A DEVICE FOR PERFORMING THE METHOD

The present invention refers to a method for preparing fibres in bundles or closely packed together lumps for aimed mixing into a sprayed concrete mass or the like as well as a device for performing the method.

BACKGROUND AND SUMMARY OF THE INVENTION

It is earlier known to add precut steel fibres to a concrete mass, which by means of concrete spraying is applied to the surface intended. The fibres have then been added in a concrete mixer or the like. The mixture thereupon has been placed in a spraying machine, whereupon it has been brought to an orifice and has been sprayed out onto a desired base.

It has proved itself that the above described type of addition of fibres to the concrete mass, limits the achievable fibre content in the mass to one or some percent of volume only, as the fibres during the mixing and the transport together with ballast and cement material has a tendency to ball or become packed together in lumps. It has therefore been necessary to use low fibre contents at the mixing, whereby the desired improvements regarding strength, fracture dispersion, deformation ability etc. cannot be achieved or will be achieved to a very limited extent only. The desired alignment of the fibres in mainly one direction is not obtained, but the fibres will randomly arrange themselves in three dimensions, whereby the reinforcing effect is essentially reduced.

It has earlier been proposed to supply the fibre material to the dry cement and ballast material in an air stream and this method has proved itself to be very successful. The steel or metal fibres are however available on the market only as short, cut pieces, which are packed together in lumps in such a manner that the fibres only with great difficulty can be separated from each other.

The purpose of the present invention is now to propose a method and a device for preparing the fibres so that they with elimination of the above mentioned drawbacks in a correct and controllable manner can be supplied to the material stream at concrete spraying. This problem has been solved thereby that the fibre bundles or fibre lumps, are disintegrated into separate fibres in a defibrating apparatus by being shredded, shaken, cut and/or tumbled in a sieve and/or a tumbler, that the separate fibres are dosed and that the separate fibres are aligned with the longitudinal direction of the fibres being essentially parallel to their direction of transport by means of unobstructed downfall upon an inclined surface followed by paralleling in an air stream in a transport duct.

This is achieved with a device comprising in combination a defibrating apparatus, designed mechanically to separate the fibres from each other, a dosing apparatus for feeding out the fibres in dosed quantities and an alignment unit for arranging the fibres in three planes and a transport duct connected to the alignment unit and provided with means for generating therein an air stream as a transport medium for the fibres.

BRIEF DESCRIPTION OF THE DRAWINGS

The invention will hereinafter be further described with reference to embodiments shown in the accompanying drawings in which like reference numerals are used to refer to equivalent parts in the various figures.

FIG. 1 shows a longitudinal section through a schematic device according to the invention, FIG. 2 shows a similar section through a modified device according to the invention, FIG. 3 shows a section through a device where the initial fibre material is a twisted wire, FIG. 4 shows a section through a device where the initial fibre material is a number of threads, FIG. 5 shows a further variant of the devices according to FIGS. 3 and 4, in which the threads also are shaped, FIG. 6 shows in larger scale a section through the forming unit according to FIG. 5.

DESCRIPTION OF THE PREFERRED EMBODIMENTS

The device according to the invention consists in each illustrated embodiment of a defibrating apparatus 1, arranged mechanically to separate the fibres from each other, a dosing device 2 for controlling the quantity of fibres delivered by the defibrating apparatus, an alignment unit 3 and a transport duct 4.

The defibrating apparatus 1 in accordance with FIGS. 1 and 2 includes a tumbler having a drum 6, which is rotatable about a preferably somewhat sloping shaft supported in a housing 7 enclosing the drum. The drum is driven by a motor 8 at a variable and comparatively low speed. The drum 6 is open at one of its ends and this end is provided with a feeding hopper 9. The opposite end of the drum is closed by means of an end wall 10 and adjacent this end wall there is arranged one or more feeding-out openings 11 along the circumference of the drum. At the lower part of the housing 7 just in front of the feeding-out openings, there is also arranged a further opening 12. A cylinder 13 is fitted inside the drum in engagement with the internal surface of the drum 6 and said cylinder can be non-rotatably connected to the drum by means of a suitable locking means. The cylinder 13 is furthermore displaceable axially in the drum towards and away from the feeding-out openings 11, whereby the size of these openings can be adjusted. At the internal side of the cylinder 13 there is fitted a large number of radial pins 14, ridges or similar projections, which effect a further separation of the fibre lumps. The feeding-out openings 11 are preferably designed as exchangeable screens to prevent even small lumps of fibres from leaving the disintegrating apparatus.

The dosing effect in the example shown in FIG. 1 is thus accomplished by the feeding-out openings, the size of which can be adjusted and/or by varing the speed of the adjustable motor 8.

A very important detail is the alignment of the fibres and the alignment unit 3 of the device is designed as an inclined surface 15 arranged below the feeding-out openings 11 and 12 and comprising a smooth polished shute, which tapers in a direction against its lower outlet. The surface could preferably - but not necessarily - be vibrated by means of a vibrator 16. A pipe end is fitted to the lower end of the inclined surface 15 and this pipe end forms an elongation of the transport duct 4. An air stream with a heavy suction effect is generated in the pipe end by means of an ejector 17 comprising a conduit 18 for pressurized air arranged in the duct. Said air stream transports the fibres past the ejector and into the transport duct 4, where a heavy stream of pressurized air prevails. From the transport duct the fibres are transported to a spray mixer 40 (for convenience shown only in FIG. 2) where the fibres are mixed with a concrete mass.

The fibres thus will be defibrated, i.e. they will be separated from each other in the defibrator 1, which is designed as a tumbler and they will be fed out at a rate related to the rotational speed of the drum and of the size of the feeding-out openings in a desired quantity to the inclined surface 15 of the alignment unit 3, where the fibres are arranged in one plane by unobstructed downfall upon the smooth shute, whereupon the fibres are made parallel by being pulled by suction into the heavy air stream in the pipe end.

In order to obtain such a good as possible adherence between the fibres and the concrete mass the steel fibres can be provided with cams, which further will increase the tendencies of forming lumps and of packing together. In such cases it can be advantageous to arrange a further apparatus for rough defibration in front of the first mentioned defibrating apparatus as seen in the direction of fibre transport and by means of this further apparatus is it possible to loosen large segregations. The rough defibrating apparatus is on the drawing shown in dash and dot lines and it is designated 19. The apparatus comprises a reciprocating sieve 20, which is arranged in a charging hopper 21 located above the feeding hopper 9 of the defibrating apparatus 1. The sieve 20 is driven by a motor 22 and it is preferably provided with teeth adapted to shred the lumps of fibres.

In cases where a most exact dosing of the fibre material is wanted a dosing apparatus 23 is arranged preferably between the rough defibrating apparatus 19 and the fine defibrating apparatus 1, which dosing device feeds out the fibres to the transport duct for obtaining desired contents in relation to weight, quantity or volume. In FIG. 2 the device according to FIG. 1 is shown with such a dosing device located between the rough defibrating apparatus 19 and the fine defibrator 1. The dosing apparatus according to this embodiment comprises a device for volume measurement, designed as a rotor 24, connected to the charging hopper 21 and also to the feeding hopper 9, said rotor being provided with a number of vertical chambers 25. The rotor is indexable by means of a step motor 26 so that each one of the chambers successively can be brought to communicate with the charging hopper 21 and the feeding hopper 9. The chambers are thus filled with fibres from the reciprocating sieve 20 and are successively emptied in the feeding hopper 9. The step motor 26 is preferably controlled by photocells, which index the rotor one step when the chamber below the charging hopper has been filled to the predetermined height.

The dosing device can of course be formed as a weighing machine or the like instead of a volume measurement device.

At the embodiment shown in FIG. 3 the defibrating apparatus 1 includes a cutting device 30, adapted to cut up a twisted wire 31 which is wound on a roller 32 in short pieces when said wire is unwound and fed into the cutting device. The length of the pieces is determined by a feeding device 33, which in the example shown is formed as motordriven rollers. When the wire pieces are cut the separate threads, i.e. the fibres will be released and they are allowed freely to fall down onto the alignment device 3, i.e. the earlier mentioned inclined surface 15, whereon the fibres will be arranged in one plane and slide down to the transport duct 4. This motion may be improved by vibrating the surface 15.

At the embodiment according to FIG. 4 the initial material used is separate long threads 34, which are wound on cylinders 35. The apparatus comprises a thread collector 36, which can be designed to form the threads into a string, which preferably is at least somewhat twisted, which string in the same manner as the wire in FIG. 3 is supplied to the defibrating apparatus 1 by means of the dosing apparatus 2 by feed rollers 33 whereupon the string is cut into short pieces. The apparatus is in other respects equal to that of FIG. 3.

Also the variant shown in FIG. 5 does work with separate threads 34 as initial material, but these threads are not collected to a string but are fed into the apparatus one by one. The threads are supplied via a dosing apparatus 2 with feeding rollers 33 to a forming and cutting device 37, by means of which the thread pieces at their ends are provided with bends or the like. The formed and cut thread pieces are allowed unobstructedly to fall down onto the alignment device 3, wherefrom they are transported to the transport duct 4. The shaping of the threads are brought about by means of suitable shaping tools shown in FIG. 6 and comprising an upper and a lower die for cold upsetting the threads. Instead of upsetting the threads it is of course possible to use other types of shaping or coining devices but it is also possible to use form cutting or stamping from a strip of sheet metal.

The invention is not limited to the embodiments shown but a number of modifications are possible within the scope of the appended claims.

What is claimed is:

1. A method for preparing hard metallic fibers, particularly steel fibers formed into bundles or closely-packed lumps, for mixing into a sprayed concrete mass, comprising the steps of:

separating the fibers by tumbling;

unobstructedly dropping the fibers upon an inclined plane to align the fibers in one plane;

subjecting the fibers to an air stream to cause the longitudinal axes of said fibers to become essentially parallel; and, mixing the fibers with a concrete mass.

2. The method of claim 1 wherein the fiber bundles or lumps are shaken in a sieve prior to tumbling.

3. The method of claim 1 and further including the step of measuring a pre-determined amount of fibers to be dropped upon the inclined plane prior to dropping said fibers.

4. The method of claim 3 wherein the measuring step is accomplished at least in part by varying the rate of tumbling of the fibers.

5. A device for preparing hard metallic fibers, particularly steel fibers formed into bundles or closely-packed lumps for mixing into a sprayed concrete mass, comprising:

defibrating means for separating the fibers mechanically;

alignment means for arranging the fibers in three planes, said alignment means including an inclined surface;

means for discharging the fibers from the defibrating means onto the inclined surface;

means for generating an air stream, the fibers on the inclined surface being entrained within the air stream, the longitudinal axes of the fibers being thereby caused to align in parallel relation; and means for mixing the entrained fibers with the concrete mass.

6. The device of claim 5 wherein the defibrating means comprises a tumbling apparatus including a drum rotatable about an inclined axis, the drum having an open end for receiving the bundles or lumps of steel fibers, the opposite end of said drum being closed by an end wall, portions of the drum adjacent to the closed end thereof having openings formed therein, the openings allowing discharge of separated fibers from said drum.

7. The device of claim 6 and further comprising a feeding hopper connected to the open end of the drum for feeding the bundles or lumps of fibers into said drum.

8. The device of claim 6 wherein the inclined surface is disposed below the openings in the drum, the fibers being discharged through said openings onto the inclined surface.

9. The device of claim 8 and further comprising means for rotating the drum, the fibers being discharged from said drum at a rate dependent on the rate of rotation of said drum.

10. The device of claim 9 wherein the rate of discharge of the fibersfrom the drum is dependent on the size of the openings in the drum.

11. The device of claim 6 and further comprising a cylinder mounted against the drum, said cylinder being unrotatably connected to the drum and displaceable toward or away from the openings in the closed end of said drum, longitudinal movement of the cylinder relative to the drum adjusting the size of the openings, the cylinder further being provided with internal radial projections for contacting the bundles of fibers on rotation of said cylinder.

12. The device of claim 6 wherein the defibrating means further comprise a reciprocating sleeve for gross defibration of the fibers prior to receipt of said fibers into the drum.

13. The device of claim 12 and further comprising shredder means associated with the sieve for shredding the bundles or lumps of fibers.

14. The device of claim 12 and further comprising measuring means disposed between the sieve and the drum, said measuring means including a rotor indexable about a substantially vertical axis, the measuring means being further provided with a plurality of vertical chambers adapted to be successively charged with said fibers.

15. The device of claim 14 and further comprising a charging hopper for charging the vertical chambers of the measuring means.

16. The device of claim 5 and further comprising a transport duct connected to the alignment means, said transport duct having said means for generating an air stream disposed therewithin, the transport duct being further connected to the means for mixing the entrained fibers with the concrete mass.

17. The device of claim 5 wherein the defibrating means comprises a reciprocating sieve.

18. The device of claim 17 and further comprising shredder means associated with the sieve for shredding the bundles of lumps of fibers.

* * * * *